US011459723B2

(12) United States Patent
Zhang et al.

(10) Patent No.: US 11,459,723 B2
(45) Date of Patent: Oct. 4, 2022

(54) ANCHOR ROD FOR POSITIONED GROUTING SUITABLE FOR PREVENTION AND CONTROL OF ENGINEERING SEEPAGE DAMAGE AND CONSTRUCTION METHOD THEREOF

(71) Applicant: Zhejiang University City College, Zhejiang (CN)

(72) Inventors: Lisha Zhang, Hangzhou (CN); Xiao Wei, Hangzhou (CN); Hongwei Ying, Hangzhou (CN); Jinhong Zhang, Hangzhou (CN); Binghe Li, Hangzhou (CN); Gang Wei, Hangzhou (CN); Chunyan Zhao, Hangzhou (CN); Yifu Sun, Hangzhou (CN)

(73) Assignee: Zhejiang University City College, Hangzhou (CN)

( * ) Notice: Subject to any disclaimer, the term of this patent is extended or adjusted under 35 U.S.C. 154(b) by 0 days.

(21) Appl. No.: 17/564,229

(22) Filed: Dec. 29, 2021

(65) Prior Publication Data

US 2022/0120052 A1 Apr. 21, 2022

Related U.S. Application Data

(63) Continuation of application No. PCT/CN2021/105863, filed on Jul. 12, 2021.

(30) Foreign Application Priority Data

Aug. 28, 2020 (CN) ..... 202010885358.2

(51) Int. Cl.
*E02D 19/06* (2006.01)
*E02D 5/80* (2006.01)
(Continued)

(52) U.S. Cl.
CPC ..... *E02D 19/06* (2013.01); *E02D 5/80* (2013.01); *E02D 15/04* (2013.01); *E02D 17/04* (2013.01)

(58) Field of Classification Search
CPC combination set(s) only.
See application file for complete search history.

(56) References Cited

U.S. PATENT DOCUMENTS 6,004,077 A * 12/1999 Saab ..... E21D 21/0086 405/302.3
7,584,577 B2 9/2009 Esmond et al.
(Continued)

FOREIGN PATENT DOCUMENTS

CN 101251017 A 8/2008
CN 104727319 A 6/2015
(Continued)

OTHER PUBLICATIONS

International Search Report (PCT/CN2021/105863); dated Oct. 11, 2021.
First Office Action(202010885358.2); dated May 18, 2021.

*Primary Examiner* — Kyle Armstrong
(74) *Attorney, Agent, or Firm* — W&G Law Group

(57) ABSTRACT

Disclosed is a positioning grouting anchor rod suitable for preventing and controlling an engineering seepage damage and a construction method thereof. The positioning anchor rod comprises an anchor rod, a grouting guide pipe and a grouting pipe. When the seepage failure occurs in the project, a water pump can be connected with a drain pipe interface to realize water drainage, and at the same time, a positioner can be used for positioning grouting in the seepage failure area to improve the accuracy of grouting reinforcement. A drainage channel and a grouting channel involved in the present application are independent of each other and do not interfere with each other, and the drainage
(Continued)

and grouting functions are combined on the basis of retaining the original supporting function of the anchor rod.

7 Claims, 2 Drawing Sheets

(51) Int. Cl.
*E02D 15/04* (2006.01)
*E02D 17/04* (2006.01)

(56) References Cited

U.S. PATENT DOCUMENTS

| | | | | |
|---|---|---|---|---|
| 2006/0159525 | A1* | 7/2006 | Moumneh | E02D 5/808 405/244 |
| 2006/0263150 | A1* | 11/2006 | Barrett | E02D 3/12 405/259.5 |
| 2018/0100280 | A1* | 4/2018 | Kim | E02D 5/80 |

FOREIGN PATENT DOCUMENTS

| | | | |
|---|---|---|---|
| CN | 204691803 | U | 10/2015 |
| CN | 105257327 | A | 1/2016 |
| CN | 105888709 | A | 8/2016 |
| CN | 110158641 | A | 8/2019 |
| CN | 112030964 | A | 12/2020 |
| JP | S6133091 | B2 * | 3/1981 |
| JP | 1088571 | A | 4/1998 |
| KR | 20080113798 | A | 12/2008 |

* cited by examiner

ANCHOR ROD FOR POSITIONED GROUTING SUITABLE FOR PREVENTION AND CONTROL OF ENGINEERING SEEPAGE DAMAGE AND CONSTRUCTION METHOD THEREOF

CROSS-REFERENCE TO RELATED APPLICATIONS

The present application is a continuation of International Application No. PCT/CN2020/105863, filed on Jul. 12, 2021, which claims priority to Chinese Application No. 202010885358.2, filed on Aug. 28, 2020, the contents of both of which are incorporated herein by reference in their entireties.

TECHNICAL FIELD

The present application relates to the technical field of anchor rod for supporting and protecting geotechnical structures, in particular to an anchor rod for positioned grouting suitable for preventing and controlling an engineering seepage damage and a construction method thereof.

BACKGROUND

With the continuous development of economy and strong support for infrastructure projects, China's underground geotechnical engineering has achieved unprecedented development. In engineering construction, groundwater seepage is a common phenomenon, but complex seepage often leads to deformation and damage of buildings and foundations, which also becomes an important cause of most engineering accidents, including deformation of foundation pit and collapse of surrounding buildings.

At present, in the slope or other underground projects, in order to improve the stability of surrounding rock and soil, a commonly used engineering treatment method is to use the shear strength of an anchor rod and a stratum to transfer the tensile force of the structure so as to strengthen the stratum itself and stabilize the soil. Because the traditional grouting anchor is used to reinforce the broken rock mass through the pressure grouting of a hollow anchor body, which is usually only suitable for support and protection for slopes of roads and railways with medium geological conditions, for tunnels prior to excavation, for foundation pit and other projects. In an actual project, there always exists such a risk that the failure of anchor reinforcement occurs due to the seepage failure resulted from complicated seepage condition, which is mainly reflected in two aspects: first, the groundwater condition will affect the force calculation of a supporting structure, resulting in inaccurate design of the anchor rod system; second, a groundwater seepage damage will reduce the gripping force between grouts and surrounding soil, and ultimately affect the overall stability of the whole anchor rod reinforcement system, that is, the traditional anchor rod cannot be directly used in projects with a complicated groundwater seepage environment.

Therefore, in order to directly prevent and control the groundwater seepage damage in the construction process, and in view of the present situation of the seepage damage of the project supported by an anchor rod, there is an urgent need for a new type of anchor rod for positioned grouting and its construction method which can save cost, shorten the construction period and effectively prevent the seepage damage of the project.

SUMMARY

In order to overcome the shortcomings of the prior art, the present application provides a new type of anchor rod for positioned grouting suitable for preventing and controlling engineering seepage failure and a construction method thereof.

The technical solution adopted by the present application to solve the technical problems is as follows:

In one aspect, the present application provides an anchor rod for positioned grouting suitable for preventing and controlling an engineering seepage damage, comprising an anchor rod, a grouting guide pipe and a grouting pipe. The anchor rod comprises a conical anchor rod end, an anchor rod body, a shim, a nut, an anchor rod cover plate and a screw; the conical anchor end, the anchor body and the anchor rod cover plate are fixedly and hermetically connected in turn; the anchor rod body is symmetrically and evenly provided with two rows of anti-filter water guide holes along an axial direction, and symmetrically and evenly provided with two rows of one-way grouting holes, and the two rows of anti-filter water guide holes and the two rows of one-way grouting holes are staggered and orthogonal to each other on a cross section of the anchor rod body; the anti-filter water guide hole are used as reserved channel holes of an anti-filter water guide pipe, and the one-way grouting holes are used as reserved channel holes of a one-way grouting pipe; the anti-filter water guide pipe has a sleeve structure and is mechanically connected with the anchor rod body through a spring device, and a nozzle is provided with an anti-filter layer.

The grouting guide pipe comprises a grouting guide pipe body and the one-way grouting pipe, the grouting guide pipe body is internally sleeved in the anchor rod body, forms a drainage channel with the anchor rod body, and is fixedly and hermetically connected with the anchor rod body at a front end face; the two rows of one-way grouting holes are symmetrically and evenly arranged on the grouting guide pipe body along the axial direction; the one-way grouting holes on the grouting guide pipe body correspond to the one-way grouting holes on the anchor rod body; the one-way grouting pipe has a sleeve structure and is mechanically connected with the grouting guide pipe body through a spring device; the bottom of the one-way grouting pipe is provided with a one-way valve; and the one-way grouting pipe can pass through the one-way grouting holes of the anchor rod body under the action of the spring device, and is pressed into a rock and soil layer.

The grouting pipe consists of a grouting pipe body, an electromagnet grouting end head and an iron limiting end; the grouting pipe body extends into the grouting guide pipe body, the end of which is fixedly connected with the electromagnet grouting end head circumferentially wrapping a first rubber ring in a form of a sleeve, and the iron limiting end circumferentially wrapping a second rubber ring is arranged between the electromagnet grouting end head and a front end face of the grouting guide pipe body.

The grouting guide pipe body is used as a movable channel of the electromagnet grouting end head and the iron limiting end, and a grouting space communicating with the grouting pipe body is formed between the electromagnet grouting end head and the iron limiting end, and the electromagnet grouting end head is magnetic after being electrified, so as to control the position of the iron limiting end to realize the grouting positioning for engineering seepage damage; in a non-working state, the electromagnet grouting end head and the iron limiting end can reach a most front end of the anchor rod.

The anchor rod cover plate is provided with a grouting pipe access opening and a drainage pipe connector, and the shim is provided with a grouting pipe access opening. The drain pipe interface is communicated with the drain channel for drainage of seepage water. The grouting pipe body passes through the grouting pipe access opening, and the screw passes through the nut and the shim in turn, extends into the grouting pipe body, and is locked by the nut, so that the screw, the nut, the shim, the anchor rod cover plate and the body of the anchor rod for positioned grouting thereof are connected in a sealing and fixed manner.

Furthermore, the nozzle of the anti-filter water guide pipe is provided with an anti-filter layer, which can prevent the loss of soil particles when pumping water at a reasonable rate.

Furthermore, the conical anchor end and the anchor body are seamlessly welded at the front end of the anchor, so that the anchor rod can be more conveniently pushed into the rock and soil layer in need of support and seepage damage resistance.

Furthermore, the one-way grouting pipe has a sleeve structure so as to be ejected by the spring device and pressed into the external rock and soil layer in a working state; the one-way valve ensures "out only", that is, grout can enter a seepage failure area through the one-way grouting pipe for reinforcement, but the seepage water and soil particles cannot enter the anchor rod through the one-way valve.

Furthermore, the first rubber ring and the second rubber ring improve the effect of sealing a surface of the grouting positioner and an inner wall of the grouting guide pipe.

In another aspect, the present application provides a construction method for an anchor rod for positioned grouting, and the method comprises the following steps:

(1) Prefabricating the anchor rod for positioned grouting, and using a drilling tool to drill holes at a place in need of anti-seepage grouting, pressing the anchor rod for positioned grouting into a rock and soil layer, and pulling a steel wire connecting a spring device to press an anti-filter water guide pipe and a one-way grouting pipe into a rock and soil layer.

(2) After the anchor rod for positioned grouting is installed, adding a proper amount of air pressure into the anchor rod to clear the holes of the one-way grouting pipe and the anti-filter water guide pipe to prevent soil particles from blocking an anti-filter layer and a one-way valve.

(3) When there is no seepage at a drilling hole, the anchor rod for positioned grouting is used for support; when seepage occurs at the drilling hole, unscrewing a screw to remove a nut and a shim thereof, then connecting a water pump to a drain pipe interface to pump water, and seepage groundwater passing through the anti-filter layer, the anti-filter water guide pipe and the anchor body respectively to flow out of the rock and soil layer; at the same time, electrifying an electromagnet grouting end head on the grouting pipe to suck an iron limiting end, pushing a grouting pipe body to make the whole grouting pipe drive the two end heads to reach a seepage position and then cutting off the power, and pulling the grouting pipe body outward to separate the two end heads, so as to ensure that there is enough grouting space between the two end heads for positioned grouting.

(4) Grouting inward through the grouting pipe by a pressure grouting device, and after the initial setting of a concrete grout, adding a proper amount of air pressure to the one-way grouting pipe before the final setting to prevent the grout from blocking the pipe.

(5) Injecting the grout into the grouting guide pipe through the grouting pipe, and then the grout entering a seepage site in the rock and soil layer through the one-way valve and the one-way grouting pipe for reinforcement.

(6) After the completion of the project, pushing a steel wire for controlling the spring device to make the anti-filter water guide pipe and the one-way grouting pipe retract into the anchor rod, and retrieving the anchor rod.

Furthermore, in step (1), the anchor rod is obliquely inserted into a soil layer, and an inclination angle of the anchor rod is 15-35°.

Compared with the prior art, the present application has the following beneficial effects:

1. Compared with the traditional method, the present application integrates the drainage and grouting treatment functions into one, which is directly used for preventing and treating a seepage damage on the basis of maintaining the original functions of the anchor rod.

2. The present application can be used for grouting at arbitrary position. After the grouting positioner is electrified, the grouting pipe, the electromagnet grouting end head and the iron limiting end can be pulled to freely move and locate in the grouting guide pipe, and sufficient grouting space can be formed between the two end heads, thus realizing the purpose of grouting at arbitrary position and improving the accuracy of grouting for treating seepage damage.

3. The present application is an innovation of the traditional anchor rod. The anti-filter water guide pipe and the one-way grouting pipe are respectively distributed in the device in one-to-one correspondence with the anti-filter water guide hole and the one-way grouting hole, and the drainage channel and the grouting channel are completely independent and do not interfere with each other, so that the purpose of grouting while draining can be achieved, and the efficiency of engineering prevention and treatment can be improved.

4. During the use of the anchor rod, the internal structure will not affect the original function of the anchor rod, and it can play the supporting and preventing functions when seepage does not occur. When seepage occurs, the internal structure plays an additional role, so that the seepage water is pumped out and positioned grouting is carried out at the same time, so as to prevent the deformation of the rock stratum inside the foundation pit caused by a seepage failure.

5. The materials used in the present application are affordable, the manufacturing process is simple, and the construction is convenient. On the premise of meeting its functional effects, the cost of traditional impermeability can be reduced, and the delay of construction period can be avoided.

6. As for the new anchor rod for positioned grouting and its construction method used in the present application for preventing and controlling an engineering seepage damage, the structural transformation and working principle thereof can provide certain reference and guidance for drainage grouting anti-seepage damage in underground roadway, slope engineering, tunnel engineering and other fields.

7. Compared with the working mode of prevention without treatment and treatment without prevention in the traditional construction, the present application can combine drainage prevention with grouting treatment, and once the leakage occurs, it can be treated, thus preventing the foundation pit from collapsing and deforming due to the loss of soil particles carried by groundwater seepage.

Figure 1:
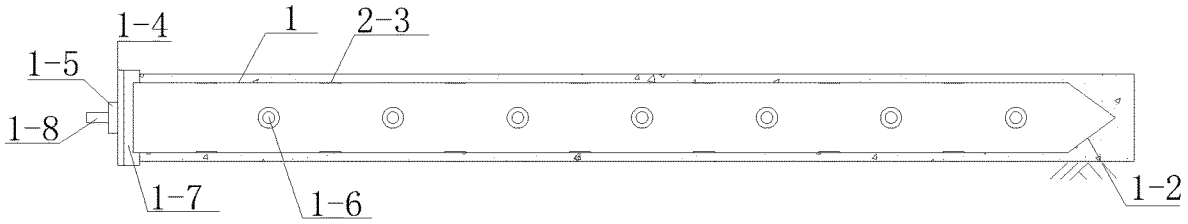
FIG. 1 is a side view of the anchor rod for positioned grouting of the present application.
Figure 2:
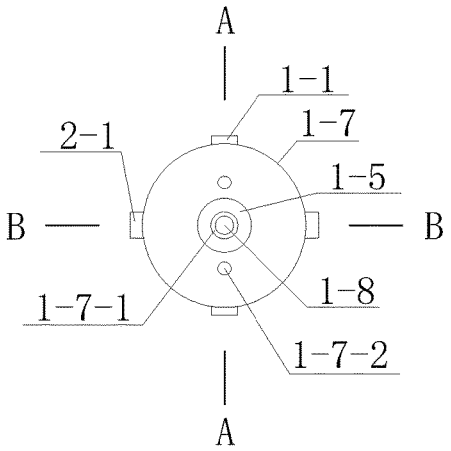
FIG. 2 is a top view of the anchor rod for positioned grouting of the present application.
Figure 3:
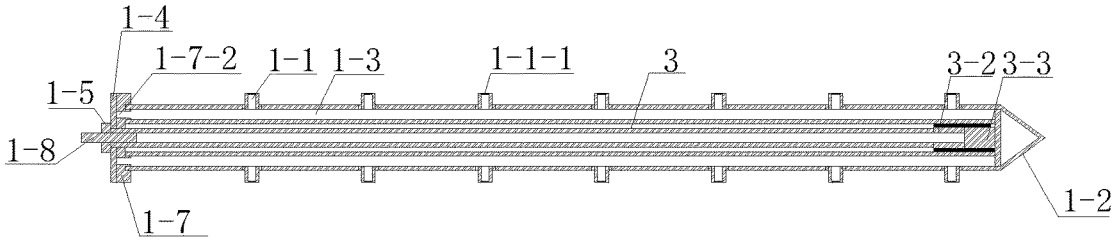
FIG. 3 is a section A-A shown in FIG. 2.
Figure 4:
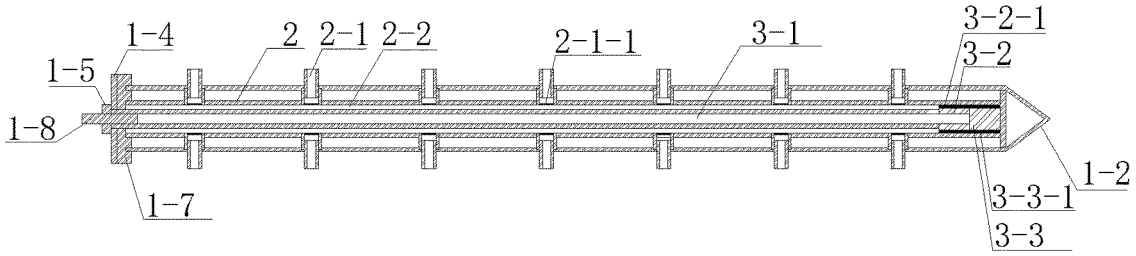
FIG. 4 is a section B-B shown in FIG. 2.

Reference signs: Anchor rod 1, Anti-filter water guide pipe 1-1, Anti-filter layer 1-1-1, Conical anchor rod end 1-2, Anchor rod body 1-3, Shim 1-4, Nut 1-5, Anti-filter water guide hole 1-6, Anchor cover plate 1-7, Grouting pipe access opening 1-7-1, Drainage pipe connector 1-7-2, Screw 1-8, Grouting guide pipe 2, One-way grouting pipe 2-1, One-way valve 2-1-1, Grouting guide pipe body 2-2, Grouting pipe 3, Grouting pipe body 3-1, Electromagnetic grouting end 3-2, First rubber ring 3-2-1, Iron limiting end 3-3, Second rubber ring 3-3-1.

DESCRIPTION OF EMBODIMENTS

The present application will be further described in detail with reference to the drawings and examples below.

As shown in FIGS. 1-4, this embodiment provides a new type of anchor rod for positioned grouting suitable for preventing and controlling an engineering seepage damage. The anchor rod for positioned grouting comprises an anchor rod 1, a grouting guide pipe 2 and a grouting pipe 3. The anchor rod 1 comprises a conical anchor rod end 1-2, an anchor rod body 1-3, a shim 1-4, a nut 1-5, an anchor rod cover plate 1-7 and a screw 1-8. The conical anchor end 1-2, the anchor body 1-3 and the anchor rod cover plate 1-7 are fixedly and hermetically connected in turn. The anchor rod body 1-3 is symmetrically and evenly provided with two rows of anti-filter water guide holes 1-6 along an axial direction, and symmetrically and evenly provided with two rows of one-way grouting holes 2-3, and the two rows of anti-filter water guide holes 1-6 and the two rows of one-way grouting holes 2-3 are staggered and orthogonal to each other on a cross section of the anchor rod body 1-3. The anti-filter water guide hole 1-6 are used as reserved channel holes of an anti-filter water guide pipe 1-1, and the one-way grouting holes 2-3 are used as reserved channel holes of a one-way grouting pipe 2-1. The anti-filter water guide pipe 1-1 has a sleeve structure and is mechanically connected with the anchor rod body 1-3 through a spring device, and a nozzle is provided with an anti-filter layer 1-1-1.

The grouting guide pipe 2 comprises a grouting guide pipe body 2-2 and the one-way grouting pipe 2-1. The grouting guide pipe body 2-2 is internally sleeved in the anchor rod body 1-3, forms a drainage channel with the anchor rod body 1-3, and is fixedly and hermetically connected with the anchor rod body 1-3 at a front end face. The two rows of one-way grouting holes 2-3 are symmetrically and evenly arranged on the grouting guide pipe body 2-2 along the axial direction. The one-way grouting holes 2-3 on the grouting guide pipe body 2-2 correspond to the one-way grouting holes 2-3 on the anchor rod body 1-3. The one-way grouting pipe 2-1 has a sleeve structure and is mechanically connected with the grouting guide pipe body 2-2 through a spring device. The bottom of the one-way grouting pipe 2-1 is provided with a one-way valve 2-1-1. The one-way grouting pipe 2-1 can pass through the one-way grouting holes 2-3 of the anchor rod body 1-3 under the action of the spring device, and is pressed into a rock and soil layer;

The grouting pipe 3 consists of a grouting pipe body 3-1, an electromagnet grouting end head 3-2 and an iron limiting end 3-3. The grouting pipe body 3-1 extends into the grouting guide pipe body 2-2, the end of which is fixedly connected with the electromagnet grouting end head 3-2 circumferentially wrapping a first rubber ring 3-2-1 in a form of a sleeve, and the iron limiting end 3-3 circumferentially wrapping a second rubber ring 3-3-1 is arranged between the electromagnet grouting end head 3-2 and a front end face of the grouting guide pipe body 2-2. The grouting guide pipe body 2-2 is used as a movable channel of the electromagnet grouting end head 3-2 and the iron limiting end 3-3, and a grouting space communicating with the grouting pipe body 3-1 is formed between the electromagnet grouting end head 3-2 and the iron limiting end 3-3, and the electromagnet grouting end head 3-2 is magnetic after being electrified, so as to control the position of the iron limiting end 3-3 to realize the grouting positioner for engineering seepage damage. In a non-working state, the electromagnet grouting end head 3-2 and the iron limiting end 3-3 can reach a most front end of the anchor rod.

The anchor rod cover plate 1-7 is provided with a grouting pipe access opening 1-7-1 and a drain pipe interface 1-7-2, and the shim 1-4 is provided with a grouting pipe access opening 1-7-1. The drain pipe interface 1-7-2 is communicated with the drain channel so as to drain seepage water. The grouting pipe body 3-1 passes through the grouting pipe access opening 1-7-1, and the screw 1-8 passes through the nut 1-5 and the shim 1-4 in turn, extends into the grouting pipe body 3-1, and is locked by the nut 1-5, so that the screw 1-8, the nut 1-5, the shim 1-4, the anchor rod cover plate 1-7 and the body of the anchor rod for positioned grouting thereof are connected in a sealing and fixed manner.

Specifically, the nozzle of the anti-filter water guide pipe 1-1 is provided with an anti-filter layer 1-1-1, which can prevent the foundation pit from collapsing and deforming due to the loss of soil particles carried by groundwater seepage. The anti-filter water guide pipe 1-1 and the one-way grouting pipe 2-1 are respectively distributed in the device in one-to-one correspondence with the anti-filter water guide hole and the one-way grouting hole, and the drainage channel and the grouting channel are completely independent and have no influence on each other, so that the purpose of grouting while draining can be achieved, and the efficiency of engineering prevention and treatment can be improved.

Specifically, the conical anchor end 1-2 and the anchor body 1-3 are seamlessly welded to the front end of the anchor rod, so that the anchor rod can be more conveniently pushed into the rock and soil layer needing support and anti-seepage damage.

Specifically, the one-way grouting pipe 2-1 has a sleeve structure, so that it can be ejected by the spring device and pressed into the external rock and soil layer in a working state. The one-way valve 2-1-1 ensures "out only", that is, the grout can enter the seepage failure area for reinforcement through the one-way grouting pipe 2-1, but the seepage water and the rock and soil layer particles cannot enter the anchor rod through the one-way valve.

This embodiment provides a construction method of an anchor rod for positioned grouting suitable for preventing and controlling an engineering seepage damage, which comprises the following steps:

Firstly, according to the use specification of the anchor rod, it can be known that the optimum inclination angle of the anchor rod is 15-35°. A drilling tool is used to drill holes at the place in need of support and grouting according to the optimum inclination angle, and the above anchor rod for positioned grouting prefabricated in the factory is pressed into the rock and soil layer. A steel wire is mechanically connected with the spring device and runs through the whole pipe, and the steel wire is pulled to drive the spring device to press the anti-filter water guide pipe 1-1 and the one-way grouting pipe 2-1 of the sleeve structure into the rock and soil layer. After the anchor rod is installed, an appropriate amount of air pressure is added into the anchor rod to blow air to the one-way grouting pipe 2-1 and the anti-filter water guide pipe 1-1 to clear the holes, so as to prevent the soil particles in the rock and soil layer from blocking the anti-filter layer and the one-way valve from affecting the working effect of the device.

Figure 5:
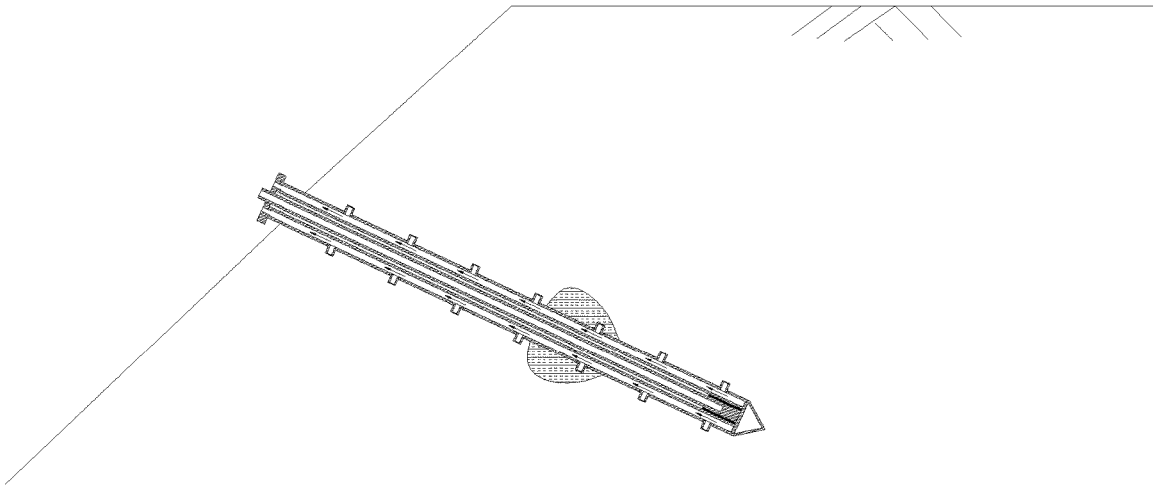
FIG. 5 is a sectional view of the water pumping process of the anchor rod for positioned grouting of the present application.

When there is no seepage at the drilling hole, the anchor rod for positioned grouting is used for engineering support and preventing seepage damage. As shown in FIG. 5, when seepage occurs at the drilling hole, the screw 1-8 is unscrewed to remove the nut 1-5 and its shim 1-4, and a water pump is used to connect the drain pipe interface 1-7-2 to pump water. The seepage groundwater flows out of the rock and soil layer through the anti-filter layer 1-1-1, the anti-filter water guide pipe 1-1 and the anchor body 1-3 respectively in the direction of the arrow in FIG. 5.

Figure 6:
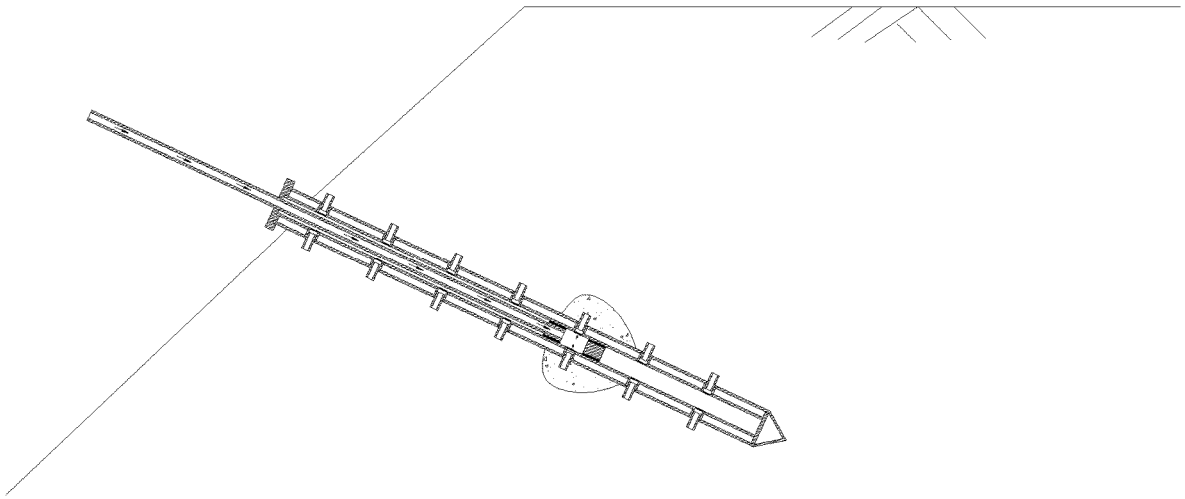
FIG. 6 is a sectional view of the grouting process of the anchor rod for positioned grouting of the present application.

At the same time, as shown in FIG. 6, an electromagnet grouting end head 3-2 on the grouting pipe 3 is electrified to such an iron limiting end 3-3, a grouting pipe body 3-1 is pushed to make the whole grouting pipe 3 drive the two end heads to reach a seepage position and then the power is cut off, and the grouting pipe body 3-1 is pulled outward to separate the two end heads, so as to ensure that there is enough grouting space between the two end heads for positioning grouting. Next, the pressure grouting device is used to inject grouting in the direction indicated by the arrow in FIG. 6 through the grouting pipe 3. After the initial setting of the concrete grout, a proper amount of air pressure is added to the one-way grouting pipe 2-1 before the final setting to prevent the grout from blocking the pipe and affecting the working effect of the device. Grout is injected into the grouting guide pipe 2 through the grouting pipe 3, and then enters the seepage in the rock and soil layer through the one-way valve 2-1-1 and the one-way grouting pipe 2-1 for reinforcement, and the construction is completed when the seepage is filled with grout. After the completion of the project, the steel wire for controlling the spring device is pushed to make the anti-filter water guide pipe 1-1 and the one-way grouting pipe 2-1 retract into the anchor rod, and the anchor rod is retrieved.

The above description is only for explaining the principle of the present application, and cannot be interpreted as limiting the scope of protection of the present application in any way. Based on the explanation here, those skilled in the art can conceive of other specific embodiments of the present application without creative efforts, which will fall within the scope of protection of the present application.

What is claimed is:

1. A positioning grouting anchor rod suitable for preventing and controlling an engineering seepage damage, comprising an anchor rod, a grouting guide pipe and a grouting pipe;

wherein the anchor rod comprises a conical anchor rod end, an anchor rod body, a shim, a nut, an anchor rod cover plate and a screw; the conical anchor end, the anchor body and the anchor rod cover plate are fixedly and hermetically connected in turn; the anchor rod body is symmetrically and evenly provided with two rows of anti-filter water guide holes along an axial direction, and symmetrically and evenly provided with two rows of one-way grouting holes, and the two rows of anti-filter water guide holes and the two rows of one-way grouting holes are staggered and orthogonal to each other on a cross section of the anchor rod body; the anti-filter water guide hole are used as reserved channel holes of an anti-filter water guide pipe, and the one-way grouting holes are used as reserved channel holes of a one-way grouting pipe; the anti-filter water guide pipe has a sleeve structure and is mechanically connected with the anchor rod body through a spring device, and a nozzle is provided with an anti-filter layer;

the grouting guide pipe comprises a grouting guide pipe body and the one-way grouting pipe, wherein the grouting guide pipe body is internally sleeved in the anchor rod body, forms a drainage channel with the anchor rod body, and is fixedly and hermetically connected with the anchor rod body at a front end face; the two rows of one-way grouting holes are symmetrically and evenly arranged on the grouting guide pipe body along the axial direction; the one-way grouting holes on the grouting guide pipe body correspond to the one-way grouting holes on the anchor rod body; the one-way grouting pipe has a sleeve structure and is mechanically connected with the grouting guide pipe body through a spring device; the bottom of the one-way grouting pipe is provided with a one-way valve; and the one-way grouting pipe is capable of passing through the one-way grouting holes of the anchor rod body under the action of the spring device, and is pressed into a rock and soil layer;

the grouting pipe consists of a grouting pipe body, an electromagnet grouting end head and an iron limiting end; the grouting pipe body extends into the grouting guide pipe body, the end of which is fixedly connected with the electromagnet grouting end head circumferentially wrapping a first rubber ring in a form of a sleeve, and the iron limiting end circumferentially wrapping a second rubber ring is arranged between the electromagnet grouting end head and a front end face of the grouting guide pipe body;

the grouting guide pipe body is used as a movable channel of the electromagnet grouting end head and the iron limiting end, and a grouting space communicating with the grouting pipe body is formed between the electromagnet grouting end head and the iron limiting end, and the electromagnet grouting end head is magnetic after being electrified, so as to control the position of the iron limiting end to realize the grouting positioning for engineering seepage damage; in a non-working state, the electromagnet grouting end head and the iron limiting end is capable of reaching a most front end of the anchor rod;

the anchor rod cover plate is provided with a grouting pipe access opening and a drain pipe interface, and the shim is provided with a grouting pipe access opening; the drain pipe interface is communicated with the drain channel so as to drain seepage water; the grouting pipe body passes through the grouting pipe access opening, and the screw passes through the nut and the shim in turn, extends into the grouting pipe body, and is locked by the nut, so that the screw, the nut, the shim, the anchor rod cover plate and the positioning grout anchor rod body are connected in a sealing and fixed manner.

2. The positioning grouting anchor rod suitable for preventing and controlling an engineering seepage damage according to claim 1, wherein the nozzle of the anti-filter water guide pipe is provided with an anti-filter layer, which is capable of preventing the loss of soil particles when pumping water at a reasonable speed.

3. The positioning grouting anchor rod suitable for preventing and controlling an engineering seepage damage according to claim 1, wherein the conical anchor end and the anchor body are seamlessly welded at the front end of the anchor, so as to prompt the anchor rod to be pushed into the rock and soil layer in need of support and seepage damage resistance.

4. The positioning grouting anchor rod suitable for preventing and controlling an engineering seepage damage according to claim 1, wherein the one-way grouting pipe has a sleeve structure so as to be ejected by the spring device and pressed into the external rock and soil layer in a working state; the one-way valve ensures a grout capable of entering a seepage failure area through the one-way grouting pipe for reinforcement (out only), but the seepage water and rock and the carried soil layer particles are prevented to enter the anchor rod through the one-way valve.

5. The positioning grouting anchor rod suitable for preventing and controlling an engineering seepage damage according to claim 1, wherein the first rubber ring and the second rubber ring improve the sealing effect between a surface of the grouting positioner and an inner wall of the grouting guide pipe.

6. A construction method for the positioning grouting anchor rod according to claim 1, wherein the method comprises the following steps:

(1) a factory prefabricating a positioning grouting anchor rod, and using a drilling tool to drill holes at a place in need of anti-seepage grouting, pressing the positioning grouting anchor rod into a rock and soil layer, and pulling a steel wire connecting a spring device to press an anti-filter water guide pipe and a one-way grouting pipe into a rock and soil layer;

(2) after the positioning grouting anchor rod is installed, adding a proper amount of air pressure into the anchor rod to clear the holes of the one-way grouting pipe and the anti-filter water guide pipe so as to prevent soil particles from blocking an anti-filter layer and a one-way valve;

(3) when there is no seepage at a drilling hole, positioning the grouting anchor rod for support; when seepage occurs at the drilling hole, unscrewing a screw to remove a nut and a shim thereof, then connecting a water pump to a drain pipe interface to pump water, and seepage groundwater passing through the anti-filter layer, the anti-filter water guide pipe and the anchor body respectively to flow out of the rock and soil layer; at the same time, electrifying an electromagnet grouting end head on the grouting pipe to suck an iron limiting end, pushing a grouting pipe body to make the whole grouting pipe drive the two end heads to reach a seepage position and then cutting off the power, and pulling the grouting pipe body outward to separate the two end heads, so as to ensure that there is enough grouting space between the two end heads for positioning grouting;

(4) grouting inward through the grouting pipe by a pressure grouting device, and after the initial setting of a concrete grout, adding a proper amount of air pressure to the one-way grouting pipe before the final setting to prevent the grout from blocking the pipe;

(5) injecting the grout into the grouting guide pipe through the grouting pipe, and then the grout entering a seepage site in the rock and soil layer through the one-way valve and the one-way grouting pipe for reinforcement;

(6) after the completion of the project, pushing a steel wire for controlling the spring device to make the anti-filter water guide pipe and the one-way grouting pipe retract into the anchor rod, and retrieving the anchor rod.

7. The construction method according to claim 6, wherein in step (1), the anchor rod is obliquely inserted into a soil layer, and an inclination angle of the anchor rod is 15-35°.

* * * * *